United States Patent [19]

Hino et al.

[11] Patent Number: 4,822,587

[45] Date of Patent: Apr. 18, 1989

[54] HIGH MODULUS PITCH-BASED CARBON FIBER AND METHOD FOR PREPARING SAME

[75] Inventors: Takashi Hino, Tokorozawa; Tsutomu Naito, Saitama; Hiroyuki Kuroda, Omiya; Eiki Tsushima, Saitama; Tomio Nomura, Higashimatsuyama, all of Japan

[73] Assignee: Toa Nenryo Kogyo Kabushiki Kaisha, Tokyo, Japan

[21] Appl. No.: 45,835

[22] Filed: May 1, 1987

[30] Foreign Application Priority Data

May 2, 1986 [JP] Japan ..... 61-101098
Sep. 24, 1986 [JP] Japan ..... 61-223789

[51] Int. Cl.[4] ..... D01F 9/12

[52] U.S. Cl. ..... 423/447.1; 423/447.2; 423/447.4; 423/447.6; 264/29.2

[58] Field of Search ..... 423/447.1, 447.2, 447.4, 423/447.6; 264/29.2

[56] References Cited

U.S. PATENT DOCUMENTS

| | | | |
|---|---|---|---|
| 3,787,541 | 1/1974 | Grindstaff et al. | 423/447.1 |
| 4,197,283 | 4/1980 | Crepaux et al. | 423/447.2 |
| 4,454,020 | 6/1984 | Izumi et al. | 423/447.2 |
| 4,574,077 | 3/1986 | Uemura et al. | 423/447.4 |
| 4,590,055 | 5/1986 | Yamada et al. | 423/447.4 |
| 4,637,925 | 1/1987 | Hiramatsu et al. | 423/447.2 |

FOREIGN PATENT DOCUMENTS

| | | | |
|---|---|---|---|
| 59-26525 | 2/1984 | Japan | 423/447.6 |
| 60-239520 | 11/1985 | Japan | 423/447.1 |
| 61-28071 | 2/1986 | Japan | 423/447.1 |

OTHER PUBLICATIONS

Hiramatsu et al., "Torayca T1000 Ultra Strength Fibre and Its Composite Properties," *Looking Ahead for Materials and Processes,* Elsevier Science (pub), 1987, pp. 1 to 8.

Guigon et al, "Heat-Treatment of High Tensile Strength Pan-Based Carbon Fibres", Composites Science and Technology, 27 (1986) pp. 1 to 23.

*Primary Examiner*—John Doll
*Assistant Examiner*—Robert M. Kunemund
*Attorney, Agent, or Firm*—Michael N. Meller

[57] ABSTRACT

Extremely high modulus carbon fibers can be produced by carbonization at a substantially lower temperature, for example, at about 2500° C. This is made possible by selectively stabilizing only an outer surface layer portion of a carbonaceous pitch-based fiber comprised mainly of optically anisotropic components, while retaining the inner portion of the fiber in a non-stabilized state and without damage to the crystallinity thereof.

19 Claims, 9 Drawing Sheets

HIGH MODULUS PITCH-BASED CARBON FIBER AND METHOD FOR PREPARING SAME

BACKGROUND OF THE INVENTION

1. Field of the Invention

The present invention relates to a high modulus pitch-based carbon fiber and a method for preparing the same. More specifically, the present invention relates to a pitch-based carbon fiber which has a high modulus of elasticity attained at a relatively low carbonization temperature. High modulus carbon fibers are used as composite materials with plastics, metals, carbon, ceramics and the like for light weight structural materials in aircraft, spacecraft, automobiles, and architecture, etc. and for high temperature materials such as those used in brake discs, rockets, etc.

2. Description of the Related Art

High tensile strength, intermediate modulus PAN (polyacrylonitrile) based-carbon fibers are prepared using polyacrylonitrile as the starting material and those prepared at a temperature above 2000° C. may have a maximum Young's modulus of about 400 GPa. However, PAN-based carbon fibers, in addition to being unpreferably expensive starting materials, are a limited in increase of crystallinity (degree of graphitization) due to their non-graphitizable property, making it difficult to attain PAN-based carbon fibers having an extremely high modulus.

Pitch-based carbon fibers are very economical, due to their cheap starting materials, and those prepared from a petroleum liquid crystal pitch by carbonizing at temperatures near 3000° C., referred as graphite fibers, exhibit an extremely high modulus of around 700 GPa (see, for example, U.S. Pat. No. 400518).

To improve the properties of pitch-based carbon fibers, such as tensile strength, Young's modulus, etc., there have been proposed, for example, carbon fibers having, in their cross section, structure oriented in the circumferential direction at an outer layer portion of the fiber and structure oriented in the radial direction or having a mozaic texture at an inner portion of the fiber (see Japanese Unexamined Patent Publication (Kokai) No. 59-53717), and carbon fibers having a radially oriented structure at an outer layer portion of the fiber and an onion-like texture at an inner core portion of the fiber, particularly when wishing to obtain an enhanced surface mechanical strength (Japanese Unexamined Patent Publication (Kokai) No. 60-239520).

Although, as mentioned above, carbon fibers having an extremely high modulus can be prepared by using a liquid crystal pitch, and some methods have been proposed for improving the properties of pitch-based carbon fibers, all of these methods require carbonization at a high temperature of near 3000° C. to attain an extremely high modulus. Carbonization at such a high temperature not only requires high production cost, but also unpreferably decreases the tensile strength of the carbon fibers.

SUMMARY OF THE INVENTION

The inventors found, during an investigation into the attainment of carbon fibers having an extremely high modulus by carbonization at a lower temperature, that it is possible to obtain such carbon fibers by making a crystallinity of the inner portion higher than that of the outer layer portion of the carbon fiber, and as a result, accomplished the present invention.

Thus, the present invention relates to a pitch-based carbon filter characterized in that the fiber comprises an inner portion and an outer layer portion thereof and the inner portion of the fiber has a substantially higher crystallinity than that of the outer layer portion. The present invention also relates to a method for preparing a pitch-based carbon fiber, characterized by spinning a carbonaceous pitch mainly comprised of optically anisotropic components to form a carbonaceous pitch fibers, making an outer layer portion of the carbonaceous pitch fiber to be selectively stabilized by oxidation, and then carbonizing the selectivelystabilized carbonaceous pitch fiber to produce a carbon fiber.

DESCRIPTION OF THE PREFERRED EMBODIMENTS

Figure 1:
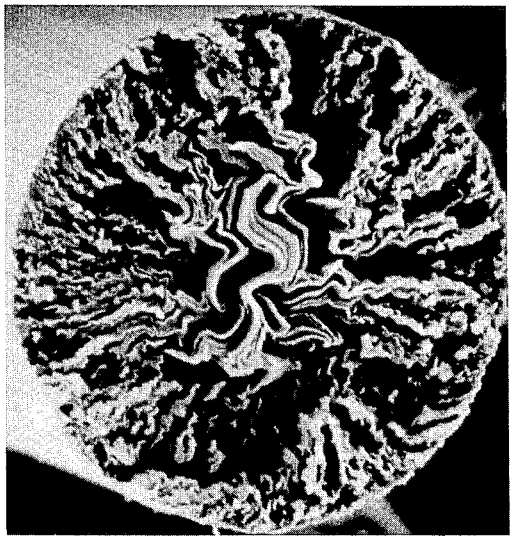
FIG. 1 is a cross section of a carbon fiber obtained in Example 1 by a scanning electron microscope.

It is known that the modulus of a carbon fiber increases with the increase of the crystallinity of the fiber. It is also believed that, to attain a high crystallinity of a carbon fiber to a degree exhibiting an extremely high modulus of near 700 GPa, it is necessary to carbonize the fiber at a high temperature of near 3000° C. in the conventional methods. In contrast, according to the present invention, it is possible to obtain carbon fibers having a modulus substantially equivalent to those attained at a carbonization temperature of near 3000° C. in the conventional method, by carbonizing the fiber at a temperature of about 500° C. lower than that of the conventional method.

This is because, in conventional methods for preparing a graphitized carbon fiber, the crystallinity of spun liquid crystal pitch fiber is decreased during the oxidative stabilization procedure. During the stabilization procedure, according to the present invention, only an outer layer portion of the pitch fiber is selectively stabilized so that the minimum stabilization to prevent fusion of the fiber during carbonization is attained, while the crystallinity of an inner portion of the pitch fiber is preserved without substantial damage so that it is possible to produce a carbon fiber having a modulus equal to or higher than those attained in conventional methods, by carbonization at a temperature substantially lower than that used in conventional methods.

Investigations into mechanism of the stabilization of pitch fibers produced from liquid crystal pitches have been extremely limited, and at present, it is considered that stabilization is attained by polymerization with a cross linking reaction due to oxidization. Little investigation has been conducted into the change of crystal structure during the stabilization step. The inventors investigated the change of crystallinity during stabilization in detail by X-ray diffraction and found that pitch fibers having a good crystallinity produced from liquid crystal pitches are subject to disturbance of the crystallinity during the stabilization process, resulting in a decrease of the crystallinity. This decrease of crystallinity during stabilization produces an inferior crystal structure of the carbonized carbon filter, and thus it is important to suppress the decrease of the crystallinity during the stabilization to a minimum necessary level, so as to obtain carbon fibers having good properties. The inventors also found that stabilization of a pitch-based fiber for preventing fusion during carbonization of the fiber can be attained while suppressing a decrease of the crystallinity of the fiber to a minimum necessary level during stabilization, by selectively stabilizing an outer layer portion of the fiber during the stabilization step. In the subsequent carbonization, the thus selectively-stabilized fibers are not fused, because the outer layer portion of the fiber is stabilized, while the crystallinity of the inner portion of the fiber is not decreased, so that the decrease of the crystallinity of the fiber as a whole is suppressed to a minimum level.

Carbon fibers produced by carbonizing pitch fibers which were selectively stabilized only in an outer layer portion generally have a higher crystallinity in an inner portion of the fibers than in the outer layer portion of the fibers. Since the outer layer portion of the carbon fiber having a lower crystallinity corresponds to the portion which was stabilized to prevent fusion of the fiber during carbonization, the thickness of the outer layer portion of the fiber may be minimum for that purpose but may be thicker than that minimum thickness as long as there remains a high crystallinity portion or a non-stabilized portion of an inner portion of the fiber. The change of the crystallinity between the outer layer portion and the inner portion of the fiber is not necessarily sharp but may be gradual. Since the necessary thickness of the outer layer portion of the fiber to be stabilized does not increase depending on the diameter of the fiber, the ratio of the inner portion having a higher crystallinity to the outer layer portion may be increased by increasing the diameter of the fiber, the modulus of the carbon fiber.

The difference of the crystallinity between the outer layer and inner portions of the carbon fiber depends on the properties of the pitch to be spun, conditions and degree of stabilization, conditions of carbonization, etc., but according to the present invention, the size of crystallites in the inner portion of the carbon fiber is at least 10% larger than that in the outer layer portion. Comparison of the size of the crystallites is conducted by obtaining selected-area electron-diffraction pattern, counting the diffraction intensity in the diffraction pattern with a microdensitometer, and comparing the reciprocal numbers of the FWHM (full width at the half maximum). If this difference of the size of the crystallite between the inner portion and outer layer portion is less than 10%, the effects of the present invention are not so obvious.

Next, preparation of the above-described pitch-based carbon fibers according to the present invention is described. A carbonaceous pitch to be spun has a high crystallinity, and is mainly comprised of optically anisotropic components (mesophase components), and is preferably a carbonaceous pitch having a softening point of 230° to 320° C. and comprising 90 to 100%, more preferably 97 to 100%, most preferably 99 to 100%, of optically anisotropic components, as described in, for example, Japanese Unexamined Patent Publication (Kokai) Nos. 57-88016, 58-45277 and 58-37084, although it is not limited thereto. Spinning may be conducted by any conventional method and the preferred carbonaceous pitch mentioned-above is preferably spun at a constant temperature in a range of 280° to 370° C.

The spun pitch fiber having a high crystallinity is selectively stabilized only in an outer layer portion of the fiber, according to the present invention. To attain this object, the pitch fiber may be subject to oxidative stabilization in a certain short period which is shorter than period of conventional oxidative stabilization. For example, pitch fibers obtained from the above preferable starting material and spinning conditions and having a diameter of 5 to 20 μm, preferably 9 to 14 μm, are stabilized in air by starting the stabilization at 150° C. to 200° C., raising the temperature at an elevation rate of more than 1° C./min, preferably 1° to 2° C./min, to a final temperature of 250° C. to 350° C., and cooling the fiber to the room temperature immediately. If the elevation rate is less than 1° C./min, too much time is required to reach the final temperature, resulting in stabilization of the fiber to the inner portion thereof. If the elevation rate is higher than 2° C./min, the fibers are fused during the stabilization step. If the elevation rate is in a range of 1° to 2° C./min, the temperature of the fibers may be increased to the final temperature in a short time period without fusion of the fibers, resulting in selective stabilization of only an outer layer portion of the fibers and resulting in stabilized fibers having a high crystallinity in the inner portion thereof. The atmosphere for stabilization may be oxygen, ozone, nitrogen dioxide, etc., instead of air. If a gas with a strong oxydizing ability is used, the elevation rate of the temperature may be higher and the final temperature may be lowered.

The minimum thickness of the outer layer portion of the fiber to be stabilized to prevent fusion of the fiber depends on the properties of pitch fiber, degree of stabolization, etc., but is considered to be, for example, about 1 μm to 3 μm. It was also found that this minimum thickness does not depend greatly on the diameter of the fiber.

The resultant pitch fibers selectivity stabilized only in their outer layer portion can be carbonized according to conventional procedures. In this carbonization procedure, the inner portion of the fiber not stabilized is carbonized while retaining a high crystallinity, and as a result, carbon fibers having a higher crystallinity in their inner portion than in their outer layer portion are produced. The conditions for carbonization may be, for example, a temperature elevation rate of 20° C./min to 500° C./min, a final (uppermost) temperature of 2000° C. to 3000° C., and a heating period of 4 min to 150 min. According to a method of the present invention, extremely high modulus carbon fibers having a Young's modulus of 700 GPa can be obtained at a carbonizing temperature of below 2600° C., for example, about 2500° C., about 500° C. lower than the 3000° C. which is necessary to attain a Young's modulus of 700 GPa in conventional methods, although the carbonization temperature in the present invention is not limited thereto.

Carbon fibers according to the present invention not only can be provided with an extremely high modulus by carbonizing at a relatively low temperature, but also can be provided with an improved tensile strength. Because the carbon fibers according to the present invention have a unique structure, in which the inner portion of the fibers has a higher crystallinity than the outer surface layer portion, the carbon fibers may exhibit unique characteristics which are not found in the carbon fibers of the prior art. The characteristics of the carbon fibers according to the present invention can be advantageously varied to some extent by selecting the starting pitch material, spinning conditions, carbonization conditions, etc., and particularly, the ratio of the stabilized portion to the entire fiber.

According to the present invention, manufacturing installation and manufacturing costs can be greatly decreased, since an extremely high modulus carbon fiber having a modulus of more than 700 GPa can be produced at a carbonization temperature lower than that in conventional methods. The efficiency of producing carbon fibers having a larger diameter, and the handling thereof, is improved in comparison with the conventional methods.

In the following Examples, the characteristics of the carbon fibers were determined by the following parameters and measuring methods.

X-RAY DIFFRACTION PARAMETERS

Preferred orientation angle ($\phi$), stack height ($L_{C002}$) and interlayer-spacing ($d_{002}$) and parameters concerning microstructure, which are obtained from wide angle X-ray diffraction. The preferred orientation angle ($\phi$) expresses the degree of preferred orientation of the crystallites in relation to the direction of fiber axis and a smaller preferred orientation angle means a higher prepared orientation. The stack height ($L_{C002}$) expresses the apparent height of the stack of the (002) planes in the carbon microcrystals. The interlayer-spacing ($d_{002}$) expressed the distance between the layers of the (002) plane of microcrystals. It is generally considered that the crystallinity is higher when the stack height ($L_{C002}$) is larger or when the interlayer-spacing ($d_{002}$) is smaller.

The preferred orientation angle ($\phi$) is measured by using a fiber sample holder. Next, while keeping the counter at that maximum diffraction intensity angle, the fiber sample holder is rotated through 360° to determine the intensity distribution of the (002) diffraction and the FWHM, i.e., the full width of the half maximum of the diffraction pattern is defined as the preferred orientation angle ($\phi$).

The stack height ($L_{C002}$) and the interlayer-spacing ($d_{002}$) are obtained by grinding the fibers, in a mortar, to a powder, conducting a measurement and analysis in accordance with *Gakushinho "Measuring Method for Lattice Constant and Crystallite Size of Artificial Graphite"*, and using the following formula.

$$L_{C002} = \frac{K\lambda}{\beta \cos\theta}$$

-continued $$d_{002} = \frac{\lambda}{2 \sin\theta}$$

where $K = 1.0$ $\frac{1}{2} = 1.5418$ Å, $\theta$ is calculated from the (002) diffraction angle $2\theta$, and $\beta$ is the FWHM of the (002) diffraction pattern calculated with correction.

TRANSMISSION ELECTRON MICROSCOPY (TEM) AND ELECTRON BEAM DIFFRACTION

Carbon fibers are aligned in the fiber axial direction and dipped in a thermo-setting epoxy resin. The resin is then cured, and the cured resin block encapsulating carbon fibers therein is trimmed so that the fibers are exposed. By an ultra-microtome equipped with a diamond knife, an ultra thin section having a thickness of less than 100 nm is cut from the block. The ultra thin section is placed on an adhesive-treated grid and bright- and dark-field images of the sample are taken by an electromicroscope. The bright-field image is a photograph by normal TEM, and the dark-field image is taken with a certain reflection and forming an image therefrom so that the state of the group of the reflection plane is observed. The (002) dark-field images in the examples were taken with the (002) plane in the same area as that of the bright-field image, with an objective aparture having a diameter of 10 $\mu$m, and by forming an image so that the state of the group of the (200) plane is observed. In such photographs, the (002) plane is shown as white and bright. Therefore, it is considered that areas where white and bright parts have a large width are areas where the (002) crystallite is well established and therefore the crystallinity is good.

To examine differences of the crystallinity between the inner portion and outer layer portion of a fiber, electron diffraction patterns are taken from specific portions of the fiber by a selected-area electron diffraction. The measuring conditions are an accelerating voltage of 200 kV and a diameter of the selected-area of about 1.7 $\mu$m, and an electron diffraction pattern is taken continuously from one edge to the opposite edge of a longitudinal section of the fiber in a direction perpendicular to the fiber axis on the ultra thin section. From the obtained diffraction patterns, the profiles of diffraction intensity in the two directions of the equator and the meridian are measured with a microdensitometer for (002) diffraction. The FWHM ($\Delta S$) of the resulting profile is determined. The size of crystallites L is obtained from the Scherrer's equation $L = K/\Delta S$, wherein K is a constant. As seen in this equation, since the size of a crystallite is in an inverse proportion to the FWHM, the sizes of the crystallites can be compared by calculating the reciprocal number of the FWHM.

EXAMPLE 1

A carbonaceous pitch containing about 50% of an optically anisotropic phase (AP) was used as a precursor pitch, which was centrifuged in a cylindrical type centrifuge with an effective volume of 200 ml in a rotor at a controlled rotor temperature of 360° C. under a centrifugal force of 10,000 G, to drain a pitch having an enriched optically anisotropic phase from an AP port. The resultant optically anisotropic pitch contained a more than 99% optically anisotropic phase and had a softening point of 271° C.

Then, the resultant optically anisotropic pitch was spun through a nozzle having a diameter of 0.3 mm, in a melt spinning machine, at 315° C.

The resultant pitch fibers were stabilized in air with a starting temperature of 180° C., a final temperature of 290° C., and an elevating rate of 2° C./min.

Upon completion of the stabilization, the fibers were subjected to carbonization in an argon atmosphere with a temperature elevation rate of 100° C./min and a final temperature of 2500° C., to obtain carbon fibers having a diameter of 13 μm.

The carbon fibers had, as seen in Table 1, a preferred orientation angle (ϕ) of 6.8°, a stack height ($L_{C002}$) of 210 Å, an interlayer-spacing ($d_{002}$) of 3.395 Å, a Young's modulus of 736 GPa, and a tensile strength of 2.77 GPa.

Figure 2A:
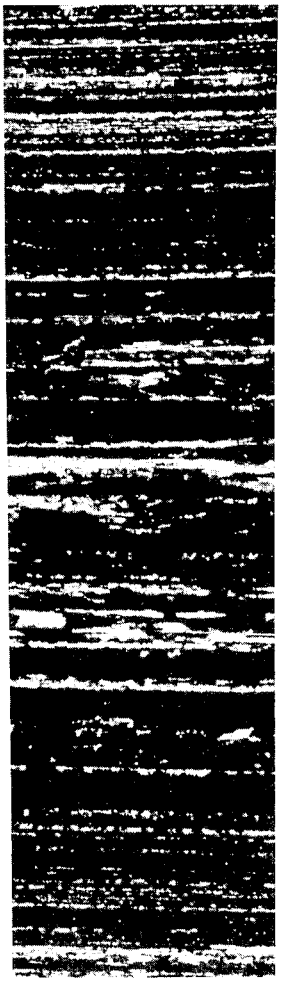
FIGS. 2A and 2B are dark- and bright-field images of a longitudinal section of the carbon fiber obtained in Example 1 by a transmission electron microscope.
Figure 2B:
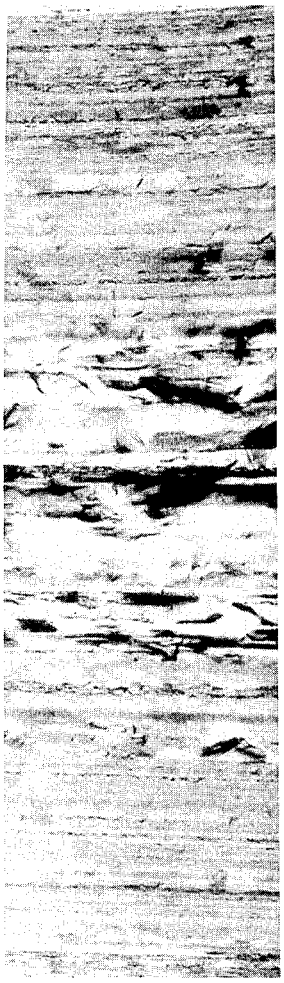

In FIG. 1, showing a scanning electron micrograph of a cross section of the obtained carbon fiber, it is seen that there is a difference of texture in the cross section between the inner portion and the outer layer portion of the fiber. In FIG. 2A, showing a (002) dark-field image of a longitudinal section of the resultant carbon fiber by a transmission electron microscope, it is seen that the width of the bright parts is larger in the inner portion than in the outer layer portion. Therefore, it is considered that in the inner portion of the fiber, the (002) stack height is larger and has a higher crystallinity than the outer layer portion. FIG. 2B is a bright-field image of a longitudinal section of the fiber by a transmission electron microscope (normal TEM) and shows that the inner portion of the fiber has a higher crystallinity than the outer layer portion. In fact, when the FWHM of the profiles of the (002) diffraction intensity in the electron diffraction pattern was measured and the size of the crystallites was calculated from the reciprocal number of the FWHM, the inner portion of the fiber had a crystallite size 21% larger than that of the outer layer portions.

EXAMPLE 2

(Comparative)

The same optically anisotropic pitch as obtained in Example 1 was spun in the same spinning machine as in Example 1 at 315° C. at a discharging amount from the nozzle which was a half of that obtained in Example 1.

The resultant pitch fibers were subject to stabilization and carbonization under the same conditions as in Example 1, to obtain carbon fibers having a diameter of about 9 μm.

The carbon fibers had, as seen in Table 1, a preferred orientation angle (ϕ) of 8.9°, a stack height ($L_{C002}$) of 160 Å, a interlayer-spacing ($d_{002}$) of 3.401 Å, a Young's modulus of 573 GPa and a tensile strength of 2.74 GPa.

Figure 3:
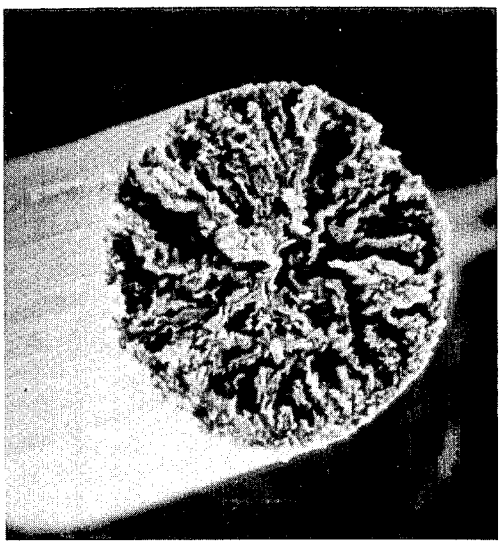
FIG. 3 is a cross section of a carbon fiber obtained in Example 2 by a scanning electron microscope.
Figure 4A:
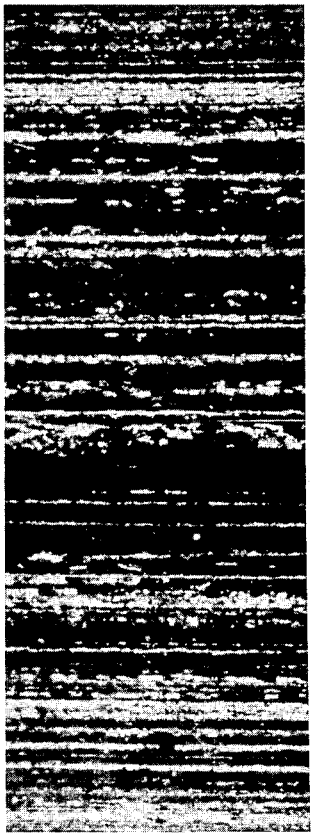
FIGS. 4A and 4B are dark- and bright-field images of a longitudinal section of the carbon fiber obtained in Example 2 by a transmission electron microscope.
Figure 4B:
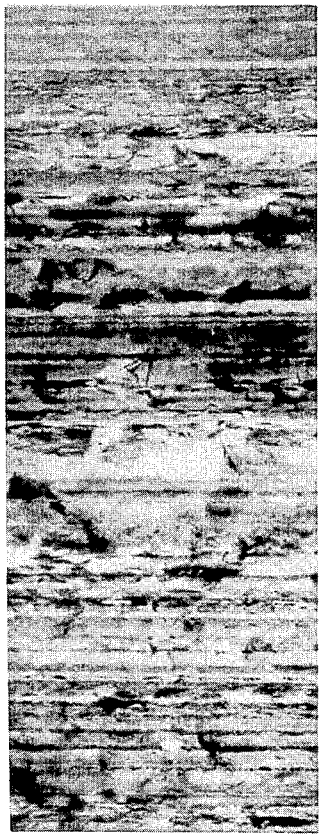

In FIG. 3, showing a photograph of a cross section of the carbon filter by a scanning electron microscope, a difference of the texture in cross section between the inner portion and the outer layer portion of the fiber cannot be seen. In the dark-field image (FIG. 4A) and the bright-field image (FIG. 4B) of a longitudinal section of the carbon fiber by a transmission electron microscope, it is deemed that there is a difference of crystallinity between the inner portion and the outer layer portion of the fiber. In fact, when the FWHM of the profile of the (002) diffraction intensity was measured in the electron diffraction pattern and the size of the crystallites was calculated from the FWHM, the inner portion of the fiber had a crystallite size 0.3% larger than that of the outer surface layer portion. Therefore, it is deemed that there is no difference between the inner portion and the outer layer portions.

EXAMPLE 3

(Comparative)

The same pitch fiber as in Example 1 was stabilized in air with a starting temperature of 180° C., an elevation rate of 0.3° C./min, and a final temperature of 290° C.

Upon completion of the stabilization, the fibers were carbonized under the same conditions as in Example 1, to obtain carbon fibers having a diameter of about 13 μm.

The carbon fibers had, as seen in Table 1, a preferred orientation angle (ϕ) of 7.0°, a stack height ($L_{C002}$) of 190 Å, a interlayer-spacing ($d_{002}$) of 3.399 Å, a Young's modulus of 685 GPa, and a tensile strength of 2.37 GPa.

Figure 5:
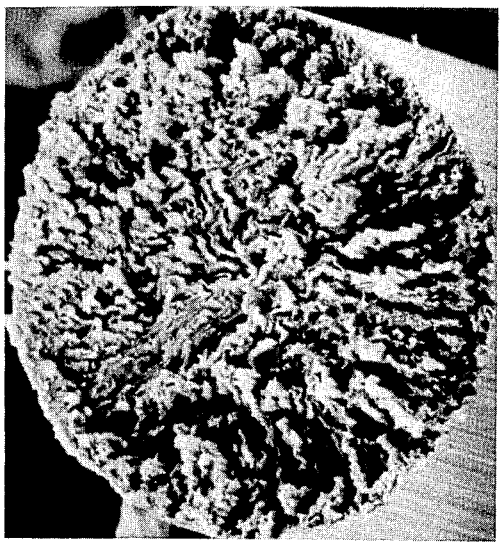
FIG. 5 is a cross section of a carbon fiber obtained in Example 3.
Figure 6A:
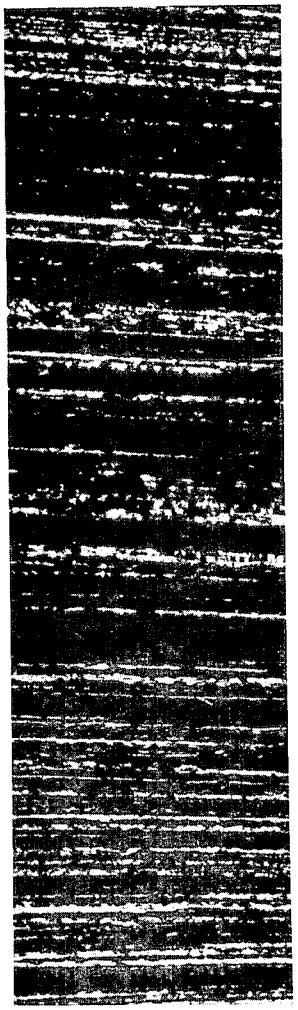
FIGS. 6A and 6B are dark- and bright-field images of a longitudinal section of the carbon fiber obtained in Example 3 by a transmission electron microscope.
Figure 6B:
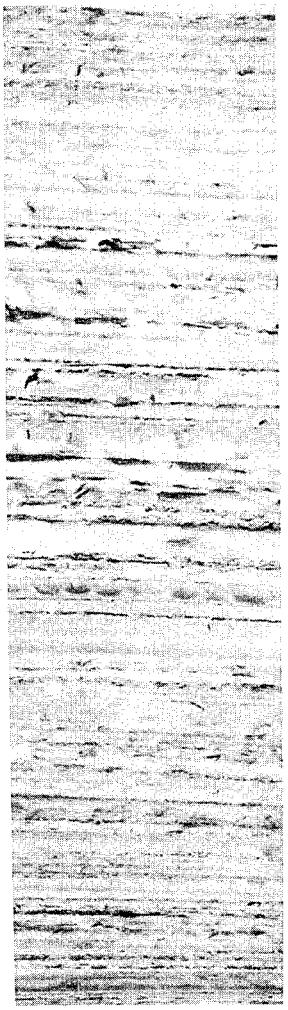

In FIG. 5, showing a photograph of a cross section of the resultant carbon fiber by a scanning electron microscope, no difference of texture in section can be seen. In the dark-field image (FIG. 6A) and the bright-field image (FIG. 6B) of a longitudinal section of the carbon fiber by a transmission electron microscope, no difference of the crystallinity between the inner and outer portions of the fiber can be seen. In fact, the sizes of the crystallites, calculated from the FWHM measured from the profile of the (002) diffraction intensity in the electron diffraction, demonstrated that the inner portion of the fiber had a crystalline size 0.2% smaller than that of the outer layer portion. That is, there was no difference of the crystallite size between the inner portion and the outer layer portions of the fiber.

EXAMPLE 4

(Comparative)

In this Example, extremely high modulus pitch-based carbon fibers, commercially available from Union Carbide Corporation as UCC-P100, were examined.

Figure 7:
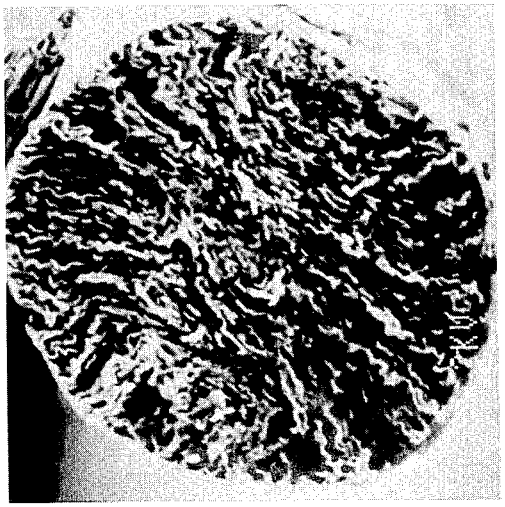
FIG. 7 is a cross section of a carbon fiber obtained in Example 4.
Figure 8A:
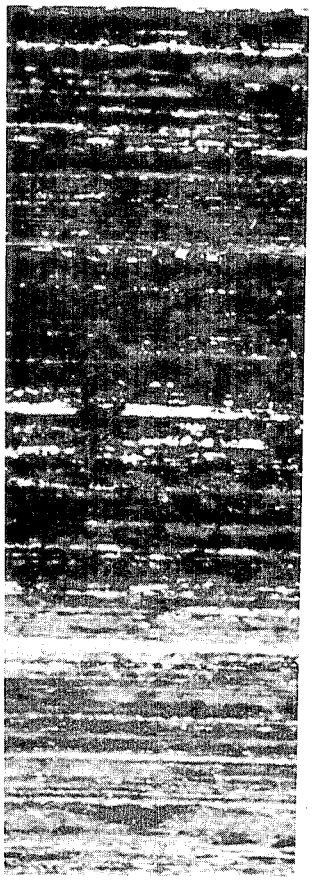
FIGS. 8A and 8B are dark- and bright-field images of a longitudinal section of the carbon fiber obtained in Example 4 by a transmission electron microscope.
Figure 8B:
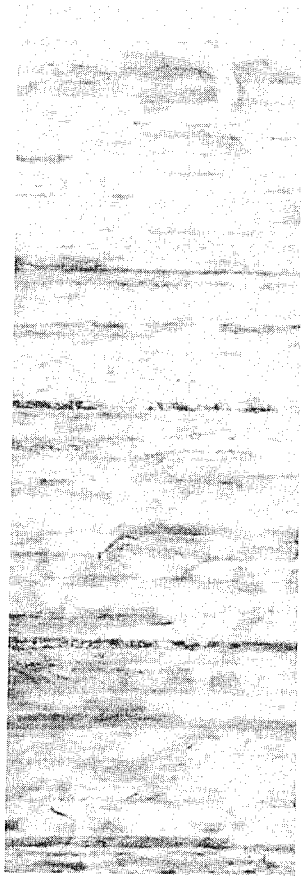

FIG. 7, showing a photograph of a cross section of the above carbon fiber by a scanning electron microscope, demonstrates that there is no clear difference of texture in the cross section between the inner portion and the outer layer portion of the fiber. In the dark-field image (FIG. 8A) and the bright-field image (FIG. 8B) of a longitudinal section of the carbon fiber by a transmission electron microscope, no difference of the crystallinity between the inner portion and the outer layer portion can be seen. When the size of the crystallites was calculated from the FWHM of the profile of the (002) diffraction intensity in the electron diffraction pattern, the crystallite size in the inner portion was 5% smaller than in the outer layer portion of the fiber. In this case, it may be said that the crystallite size is rather smaller in the inner portion than in the outer surface layer portion.

TABLE 1

| Sample | Stabilization conditions: Atmosphere | Starting/Final temperatures °C. | Elevation rate °C./min | Carbonization temperature °C. | Fiber diameter μm | Young's Modulus GPa | X-ray parameters: ϕ | $L_{C002}$ Å | $d_{002}$ Å | Tensile strength GPa |
|---|---|---|---|---|---|---|---|---|---|---|
| Ex. 1 | Air | 180/290 | 2.0 | 2500 | 13 | 736 | 6.8 | 210 | 3.395 | 2.77 |
| Ex. 2 | Air | 180/290 | 2.0 | 2500 | 9 | 573 | 8.9 | 160 | 3.401 | 2.74 |
| Ex. 3 | Air | 180/290 | 0.3 | 2500 | 13 | 685 | 7.0 | 190 | 3.399 | 2.37 |

Note
Ex. 2 and Ex. 3 are comparative.

EXAMPLE 5

The same procedures as in Example 1 were repeated to produce carbon fibers, but the carbon fibers produced had diameters of 9.6 μm, 11.5 μm, 12.5 μm, and 14 μm, respectively.

Figure 9:
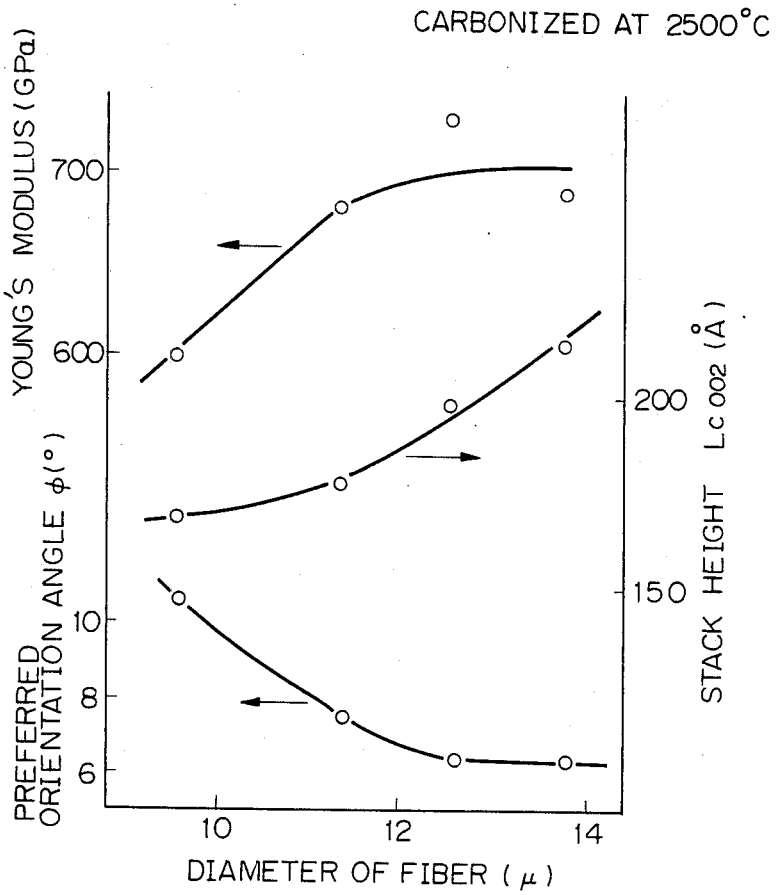
FIG. 9 is a graph showing the dependencies of characteristics of the carbon fiber obtained in Example 5 on the diameter of the fiber.

The preferred orientation angle (ϕ), the stack height ($L_{C002}$), and the Young's modulus of the above carbon fibers were measured and plotted in a graph in relation to the diameter of the carbon fiber, as shown in FIG. 9. It can be seen in FIG. 9 that as the diameter of the carbon fiber increased, the preferred orientation angle (ϕ) decreased but the stack height ($L_{C002}$) and the (Young's) modulus increased. These results demonstrate that, when the diameter of the fiber is increased, the ratio of the inner portion of the carbon fiber having a good crystallinity to the outer layer portion having a decreased crystallinity is increased, so that the crystallinity of the carbon fiber as a whole is improved, because the outer layer portion which must be stabilized does not depend on the diameter of the fiber.

We claim:

1. A pitch-based carbon fiber having a Young's modulus of at least 700GPa in which the fiber is made from a carbonaceous pitch composed of more than 90% of optically anisotropic components and comprises an inner portion and an outer layer portion thereof, the inner portion of the fiber having an average size of crystallites at least 10% larger than that of the outer layer portion, the thickness of the outer portion of the fiber being in the range of 1–3 μm.

2. A carbon fiber according to claim 1, wherein the inner portion of the fiber has a crystalline size at least 10% larger than that of the outer layer portion.

3. A carbon fiber according to claim 1, wherein the fiber has a Young's modulus of 700 GPa or more.

4. A method for preparing a pitch-based carbon fiber having a Young's modulus of at least 700 GPa comprising spinning a carbonaceous pitch composed of more than 90% of optically anisotropic components to form a carbonaceous pitch fiber, selectively stabilizing an outer layer portion of the carbonaceous pitch fiber by placing the carbonaceous pitch fiber in an oxidizing atmosphere wherein only the outer layer portion thereof is oxidized and not oxidizing the inner portion thereof, the thickness of the outer surface portion of the fiber being in the range of 1–3 μm and then carbonizing the selectively-stabilized carbonaceous pitch fiber to produce a carbon fiber having an average size of crystallites in the inner portion at least 10% higher than in the outer layer thereof.

5. A method according to claim 4, wherein said carbonization is conducted at a temperature in a range of from 2000° C. to 3000° C.

6. A method according to claim 4, wherein said carbonization is conducted at a temperature in a range of from 2000° C. to 2600° C.

7. A method according to claim 4, wherein said carbonaceous pitch comprises more than 90% of optically anisotropic components and said pitch has a softening point of 230° to 320° C.

8. A method according to claim 7, wherein said carbonaceous pitch comprises more than 97% of optically anisotropic components.

9. A method according to claim 8, wherein said carbonaceous pitch comprises more than 99% of optically anisotropic components.

10. A method according to claim 4, wherein said spinning is conducted at a temperature of 280° to 370° C.

11. A method according to claim 7, wherein said pitch fiber has a diameter of 5 to 20 μm and said stabilization is conducted in air under conditions of a starting temperature of 150° to 200° C., a temperature elevation rate of 1° to 2° C./min and a final temperature of 250° to 350° C.

12. A method according to claim 11, wherein said fiber has a diameter of 9 to 14 μm.

13. A carbon fiber according to claim 1, wherein the layer thickness of the outer layer portion of the carbon fiber is at least 1 μm.

14. A carbon fiber according to claim 13, wherein the layer thickness of the outer layer portion of the carbon fiber is at least 3 μm.

15. A pitch-based carbon fiber according to claim 1 in which the optically anisotropic components which have been stabilized by selectively oxidizing the outer portion of the carbonaceous pitch fiber and not oxidizing the inner portion thereof, said selectively stabilized carbonaceous pitch fiber then having been carbonized.

16. A pitch-based carbon fiber according to claim 15 wherein said carbonaceous pitch has a softening point of 230° to 320° C.

17. A pitch-based carbon fiber according to claim 16 wherein said carbonaceous pitch comprises more than 97% of optically anisotropic components.

18. A method for preparing a pitch-based carbon fiber according to claim 4 wherein said fiber has an inner and outer layer wherein the outer layer portion of the carbon fiber is at least at least.

19. A method according to claim 18 wherein the outer layer portion of the carbon fiber is at least at least.

* * * * *